US007619565B2

(12) United States Patent
Chen et al.

(10) Patent No.: US 7,619,565 B2
(45) Date of Patent: Nov. 17, 2009

(54) WIDEBAND PLANAR DIPOLE ANTENNA

(75) Inventors: Oscal Tzyh-Chiang Chen, Yonghe (TW); Timothy Tian-Shyi Chen, Jhudong Township, Hsinchu County (TW); Kuo-Yu Chen, Tainan (TW); Chih-Chi Ling, Taipei (TW); Min-Chin Lee, Yuanchang Township, Yunlin County (TW)

(73) Assignee: Aonvision Technology Corp., Hsinchu (TW)

( * ) Notice: Subject to any disclaimer, the term of this patent is extended or adjusted under 35 U.S.C. 154(b) by 0 days.

(21) Appl. No.: 11/467,537

(22) Filed: Aug. 25, 2006

(65) Prior Publication Data

US 2007/0046557 A1 Mar. 1, 2007

(30) Foreign Application Priority Data

Aug. 26, 2005 (TW) ..... 94214795 U

(51) Int. Cl.
*H01Q 1/38* (2006.01)
*H01Q 1/36* (2006.01)

(52) U.S. Cl. ..... 343/700 MS; 343/793; 343/795; 343/895

(58) Field of Classification Search ..... 343/700 MS, 343/793, 795, 895
See application file for complete search history.

(56) References Cited

U.S. PATENT DOCUMENTS 4,278,980 A * 7/1981 Ogita et al. ..... 343/748
4,860,019 A 8/1989 Jiang et al.
5,198,826 A 3/1993 Ito
5,541,611 A 7/1996 Peng et al.
5,754,145 A 5/1998 Evans
5,966,096 A 10/1999 Brachat
6,037,911 A 3/2000 Brankovic et al.
6,057,803 A * 5/2000 Kane et al. ..... 343/713
6,078,298 A 6/2000 Planning et al.
6,362,784 B1 * 3/2002 Kane et al. ..... 343/700 MS
6,377,227 B1 4/2002 Zhu et al.
6,483,476 B2 11/2002 Cox
6,486,843 B2 11/2002 Wang et al.
6,774,850 B2 8/2004 Chen
6,842,158 B2 * 1/2005 Jo et al. ..... 343/895
6,906,678 B2 6/2005 Chen
6,917,332 B2 7/2005 Aikawa et al.
6,924,768 B2 8/2005 Wu et al.
7,015,860 B2 3/2006 Alsliety
7,038,636 B2 5/2006 Larouche et al.
7,075,435 B2 * 7/2006 Jesser ..... 340/572.1

(Continued)

*Primary Examiner*—Trinh V Dinh
(74) *Attorney, Agent, or Firm*—Muncy, Geissler, Olds & Lowe, PLLC

(57) ABSTRACT

A wideband planar dipole antenna comprises a substrate and two antenna bodies. Metal conductor is printed on the single surface/double surfaces of the substrate to form the antenna bodies. With a dipole antenna architecture, the antenna bodies are manufactured as loop structures similar to concentric circles. The loop structures can be of rectangular or circular shapes. Loops of metal conductors with different lengths resonate to obtain similar but different frequencies. Each path of every antenna body can be finally connected with a metal conductor sheet capable of changing to any shape. Every path can interfere with adjacent paths to achieve the wideband effect. An asymmetric mechanism can be added in one of the antenna bodies. Besides letting the antenna have the resonance effect of the symmetric part, the loop path at the signal source can also be increased to enhance the receiving performance of the antenna.

12 Claims, 12 Drawing Sheets

U.S. PATENT DOCUMENTS

| | | | | |
|---|---|---|---|---|
| 7,075,498 | B2 * | 7/2006 | Gottl et al. | 343/797 |
| 2002/0084943 | A1 * | 7/2002 | Tsai et al. | 343/795 |
| 2002/0149521 | A1 * | 10/2002 | Hendler et al. | 343/700 MS |
| 2003/0156065 | A1 * | 8/2003 | Jo et al. | 343/700 MS |
| 2005/0195112 | A1 * | 9/2005 | Baliarda et al. | 343/700 MS |
| 2006/0214867 | A1 * | 9/2006 | Chen | 343/795 |

* cited by examiner

WIDEBAND PLANAR DIPOLE ANTENNA

BACKGROUND OF THE INVENTION

1. Field of the Invention

The present invention relates to a wideband planar dipole antenna and, more particularly, to a single-surface/double-surface wideband planar dipole antenna that is manufactured by using a symmetric or asymmetric mechanism.

2. Description of Related Art

Digital TV broadcasting systems have developed very quickly in recent years. In order to receive all programs in the UHF band, a digital TV UHF antenna with the operational frequency from 470 MHz to 860 MHz is usually required. Existent antennas used in the UHF band are commonly yagi antennas or rod antennas, both of which are illustrated below.

A yagi antenna is composed of many antennas at different lengths, and achieves the wideband effect by combining different resonance frequencies. This kind of antenna has a better receiving performance when installed outdoors. The yagi antenna, however, is bulky and heavy, and is therefore not suitable to the applications of indoor digital TV systems. A rod antenna is based on the principle of monopole antenna. The length of this kind of antenna is designed to be a quarter of the wavelength ($\lambda/4$). Commercially, a rod antenna is spirally wound to shorten its effective length, and a ground plane is finally added at the base of the antenna to finish a rod antenna with a minimized size. This kind of antenna has a slightly inferior receiving performance, and is less convenient in use. The above two kinds of antennas have a high manufacturing cost, and is too large in size.

In consideration of the above drawbacks of existent digital TV antennas, i.e., bulky size, inconvenient portability and high cost, the present invention aims to provide a wideband planar dipole antenna to solve the above problems in the prior art.

SUMMARY OF THE INVENTION

An object of the present invention is to provide a wideband planar dipole antenna having the characteristics of small size, light weight, easy manufacturing, and low cost. Moreover, the wideband planar dipole antenna can adhere to the surface of any object without affecting the appearance and structure of the object. The wideband planar dipole antenna can also be designed to be an indoor UHF antenna that brings much convenience for digital TV.

Another object of the present invention is to provide a wideband planar dipole antenna, wherein an asymmetric mechanism can be added in an antenna body to enhance the receiving performance of antenna.

To achieve the above objects, the present invention provides a wideband planar dipole antenna, which comprises a substrate, a first antenna body and a second antenna body. The first antenna body is used as the signal source, and the second antenna body is used as the ground. The first antenna body is located on one side of the substrate, made of a metal conductor, and printed on the substrate in a multi-loop routing way to be used as a radiation area. The first antenna body also has a metal conductor with an arbitrary polygon shape to let a part or all of multiple loops in the first antenna body be connected together. The second antenna body is located on the substrate and adjacent to the first antenna body. The second antenna body is made of a metal conductor, and is printed on the substrate in a multi-loop routing way to be used as a radiation area. The second antenna body also has a metal conductor with an arbitrary polygon shape to let a part or all of multiple loops in the second antenna body be connected together, thereby forming a single-surface wideband planar dipole antenna. Besides, two feed lines can also penetrate the substrate and connect part of the multiple loops in the first and second antenna bodies that are printed on two surfaces of the substrate to form a double-surface wideband planar dipole antenna. By manufacturing a rectangular structure similar to concentric circles, loops of metal conductors with different lengths resonate to obtain similar but different frequencies. Each path of every antenna body can be connected with a metal conductor sheet capable of changing to any shape. In this way, in addition to producing the original resonance phenomenon, every path can interfere with adjacent paths to achieve the wideband effect. Moreover, an asymmetric mechanism can also be added in one of the antenna bodies. Besides letting the antenna have the resonance effect of the symmetric part, the loop path at the signal source can also be extra increased to enhance the receiving performance of the antenna, minimize the total return loss of the antenna.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

In a wideband planar dipole antenna of the present invention, metal conductor such as copper foil can be printed on one surface or double surfaces of the substrate to form an antenna. The produced usable frequency range is primary between 470 MHz and 860 MHz. The wideband planar dipole antenna of the present invention makes use of the basic architecture of a printed planar dipole antenna. It is only necessary to form the designed pattern on a single surface or double surfaces of the substrate and use loops of metal conductors with different lengths to resonate at different frequencies so as to achieve the wideband effect. Moreover, an asymmetric mechanism can be added in the antenna pattern to enhance the receiving performance of the antenna. The substrate can be selected among media of appropriate thickness and dielectric constant such as glass, ceramic and silicon. Different materials have different performances. In all embodiments of the present invention, an FR4 Printed Circuit Board (PCB) is selected as the medium of the substrate, and the thickness is properly adjusted according to different demands.

Figure 1:
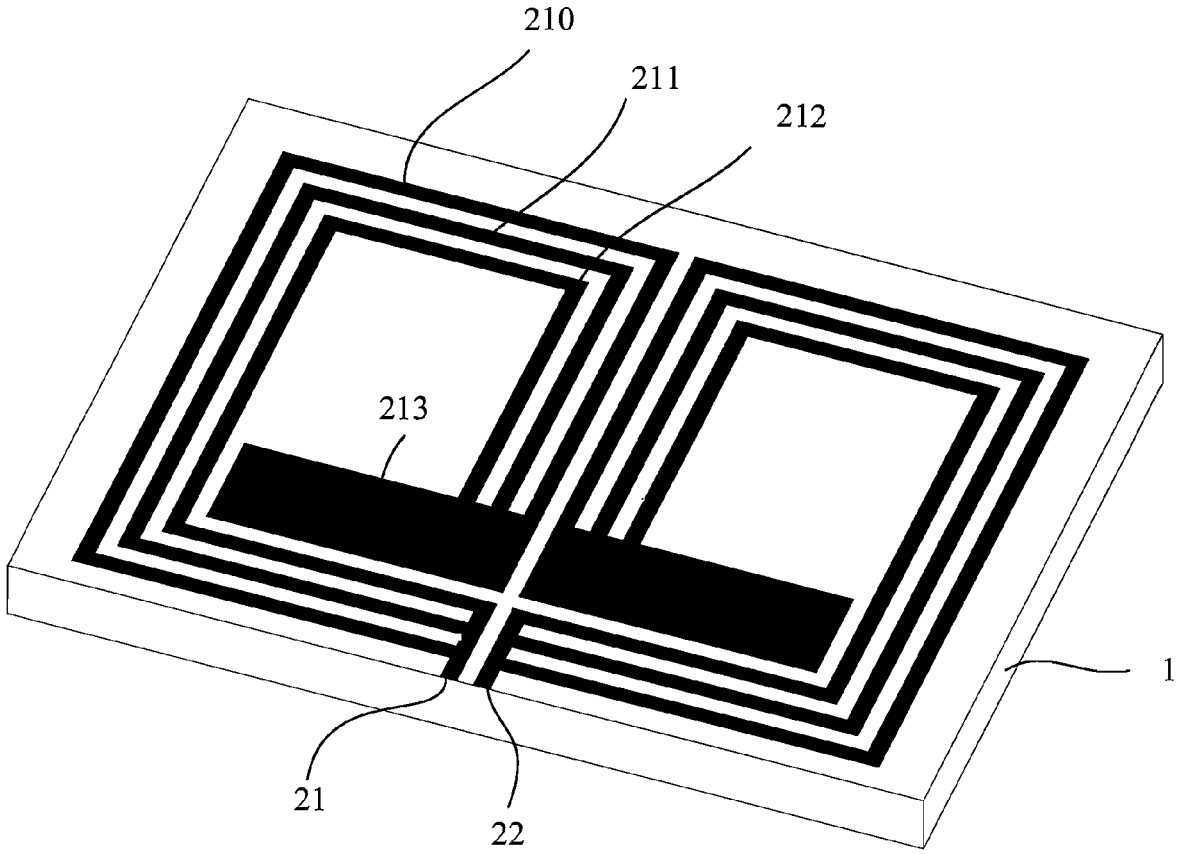
FIG. 1 is a diagram of the antenna architecture according to a first embodiment of the present invention.
Figure 2:
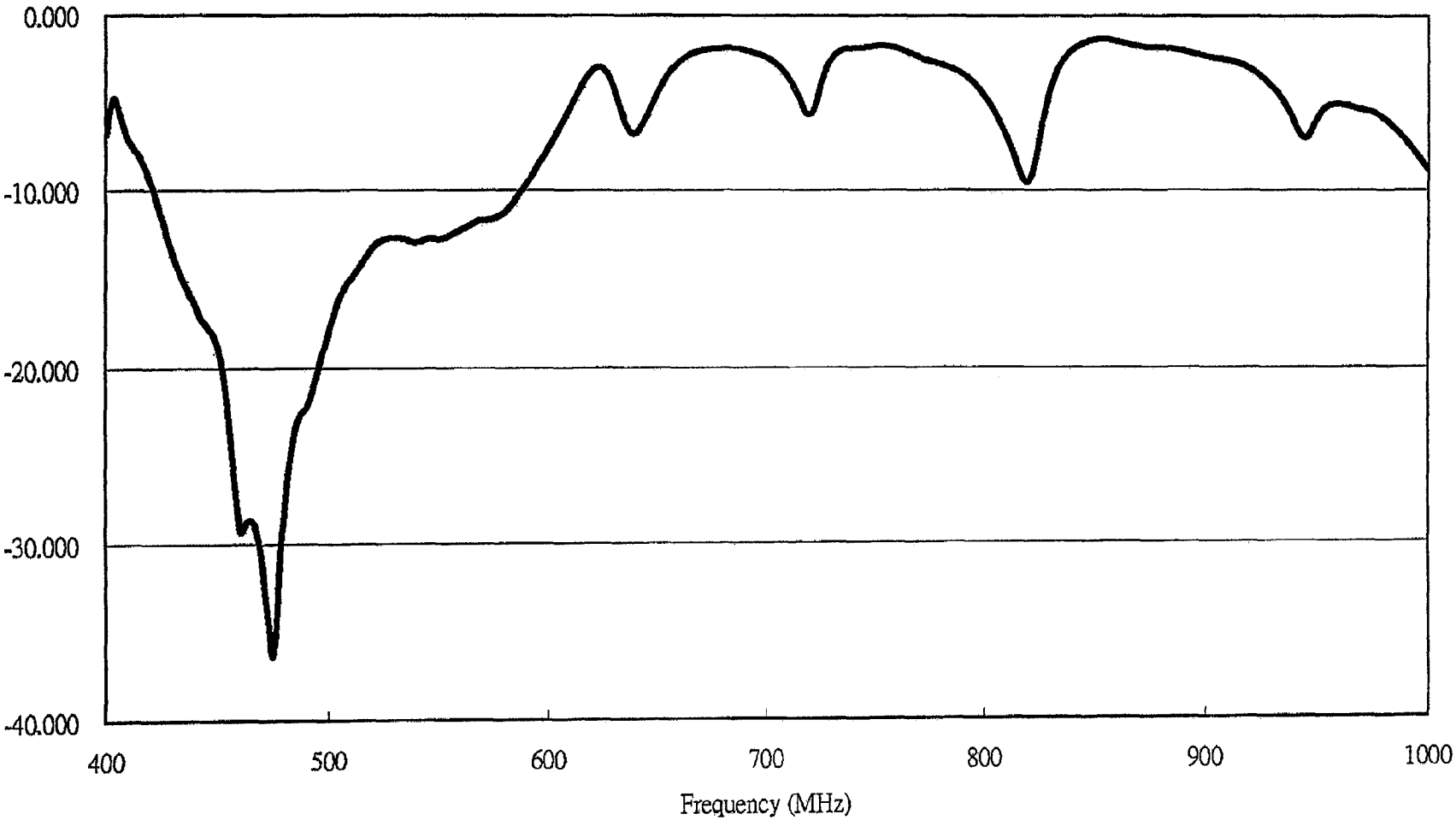
FIG. 2 is a diagram of the experimental data according to the first embodiment of the present invention.

FIG. 1 shows a wideband planar dipole antenna according to the first embodiment of the present invention. As shown in FIG. 1, the wideband planar dipole antenna comprises a substrate 1 and dipole antenna bodies 21 and 22. Copper foil is printed on the upper surface of the substrate 1 to form the dipole antenna bodies 21 and 22. The antenna bodies 21 and 22 are two mutually symmetric patterns. The antenna body 21 is the ground, while the antenna body 22 is the signal source. Each of the antenna bodies 21 and 22 is composed of three-loop copper foils 210, 211 and 212 and a quadrilateral copper foil 213. The loop copper foil 210 is the outmost perimeter of the antenna bodies 21 and 22, surrounds a rectangle with an appropriate size, and is finally connected to the quadrilateral copper foil 213. Its surrounding length is the longest of all the loop copper foils. The loop copper foil 210 is used to resonate at the lowest frequency in the designed frequency band. At an appropriate spacing, the loop copper foil 211 surrounds a rectangle inside the loop copper foil 210, and is finally connected to the quadrilateral copper foil 213. Its surrounding length is slightly shorter than that of the loop copper foil 210. Again at an appropriate spacing, the loop copper foil 212 surrounds a rectangle inside the loop copper foil 211, and is finally connected to the quadrilateral copper foil 213. Its surrounding length is slightly shorter than that of the loop copper foil 211. The antenna bodies 21 and 22 are symmetric to each other. The first embodiment of the present invention makes use of the three-loop copper foils 210, 211 and 212 and the quadrilateral copper foil 213 located at the center to combine their resonance effects, forming an antenna having a 200 MHz-bandwidth at the UHF band. Measured data of the return loss (S11) in FIG. 2 shows that the frequency range with the S11 below −10 dB is the preferred usage range of the present invention.

Figure 3:
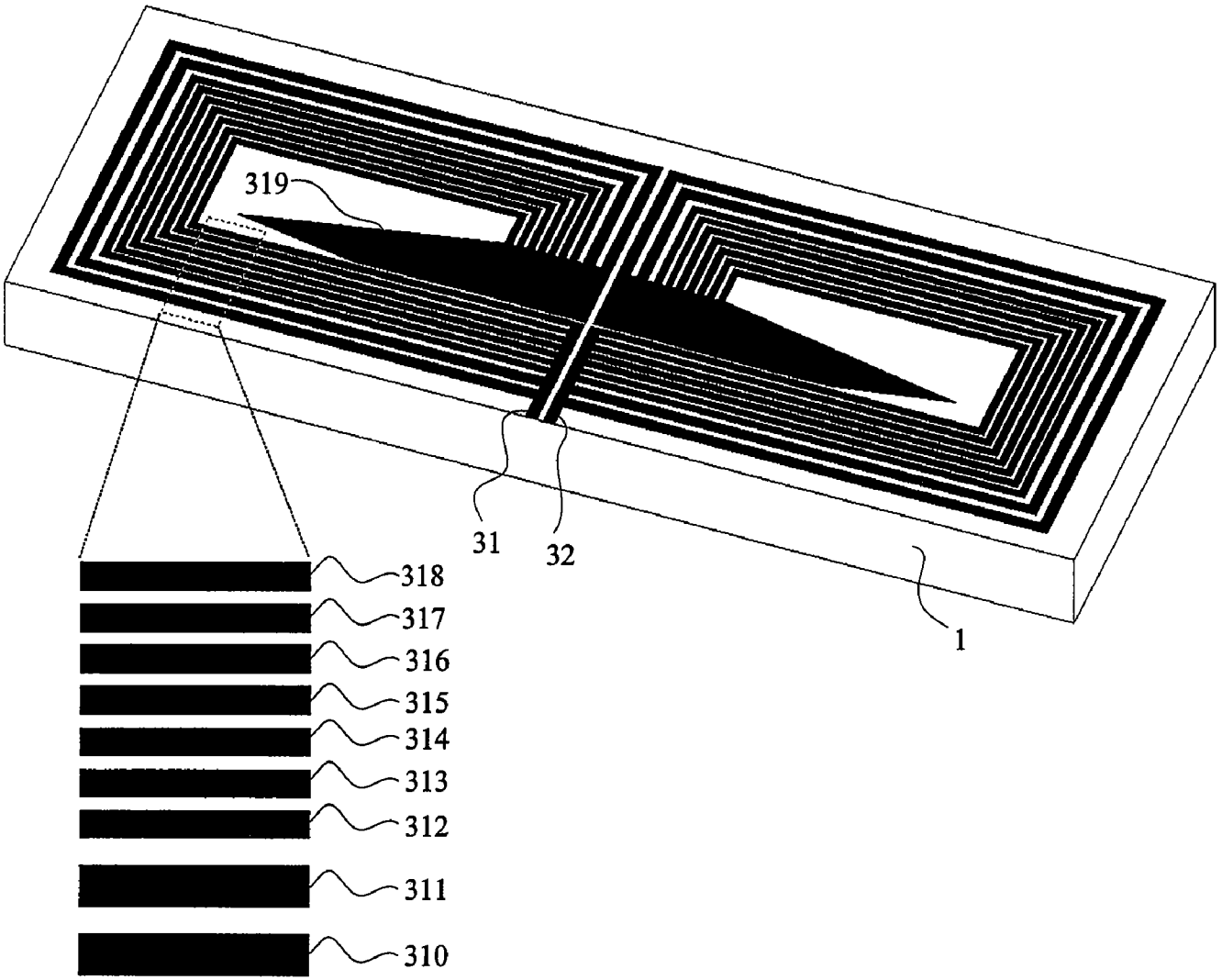
FIG. 3 is a diagram of the antenna architecture according to a second embodiment of the present invention.

The second embodiment of the present invention differs from the first embodiment in that the number of loop copper foils is increased to enlarge the bandwidth of the antenna. As shown in FIG. 3, the wideband planar dipole antenna comprises a substrate 1 and dipole antenna bodies 31 and 32. Copper foil is printed on the upper surface of the substrate 1 to form the dipole antenna bodies 31 and 32. The antenna bodies 31 and 32 are two mutually symmetric patterns. The antenna body 31 is the ground, while the antenna body 32 is the signal source. Each of the antenna bodies 31 and 32 is composed of nine loop copper foils 310, 311, 312, 313, 314, 315, 316, 317 and 318 and a polygonal copper foil 319. The loop copper foil 310 is the outmost perimeter of the antenna bodies 31 and 32, surrounds a rectangle with an appropriate size, and is finally connected to the polygonal copper foil 319. Its surrounding length is the longest of all the loop copper foils. The loop copper foil 310 is used to resonate at the lowest frequency in the designed frequency band. At an appropriate spacing, the loop copper foil 311 surrounds a rectangle inside the loop copper foil 310, and is finally connected to the polygonal copper foil 319. Its surrounding length is slightly shorter than that of the loop copper foil 310. Reasoning by analogy, at respectively appropriate spacing, the loop copper foil 312 surrounds a rectangle inside the loop copper foil 311, the loop copper foil 313 surrounds a rectangle inside the loop copper foil 312, the loop copper foil 314 surrounds a rectangle inside the loop copper foil 313, the loop copper foil 315 surrounds a rectangle inside the loop copper foil 314, the loop copper foil 316 surrounds a rectangle inside the loop copper foil 315, the loop copper foil 317 surrounds a rectangle inside the loop copper foil 316, the loop copper foil 318 surrounds a rectangle inside the loop copper foil 317, and they all are finally connected to the polygonal copper foil 319. The surrounding lengths of the loop copper foils 310, 311, 312, 313, 314, 315, 316, 317 and 318 diminish gradually, with the loop copper foil 310 having the longest length and the loop copper foil 318 having the shortest length. The antenna bodies 31 and 32 are symmetric to each other.

Figure 4:
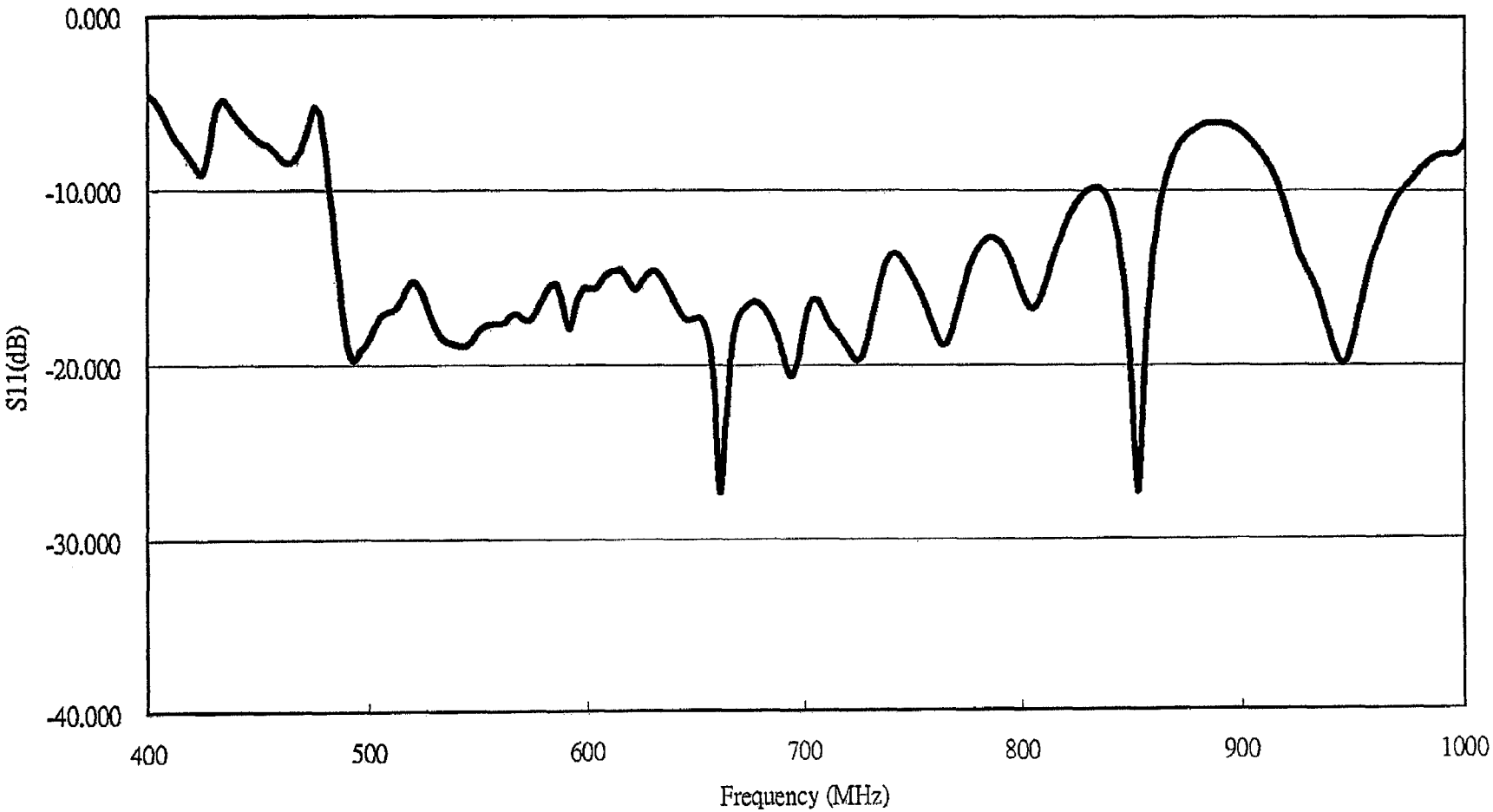
FIG. 4 is a diagram of the experimental data according to the second embodiment of the present invention.

The second embodiment of the present invention makes use of the nine-loop copper foils 310~318 and the polygonal copper foil 319 located at the center to combine their resonance effects, forming an antenna having a 380 MHz-bandwidth at the UHF band. The obtained antenna is a very wideband antenna with a center frequency of 655 MHz and a 58% bandwidth ratio. Measured data of the return loss (S11) in FIG. 4 shows that the frequency range with the S11 below −10 dB is the preferred usage range of the present invention.

Figure 5:
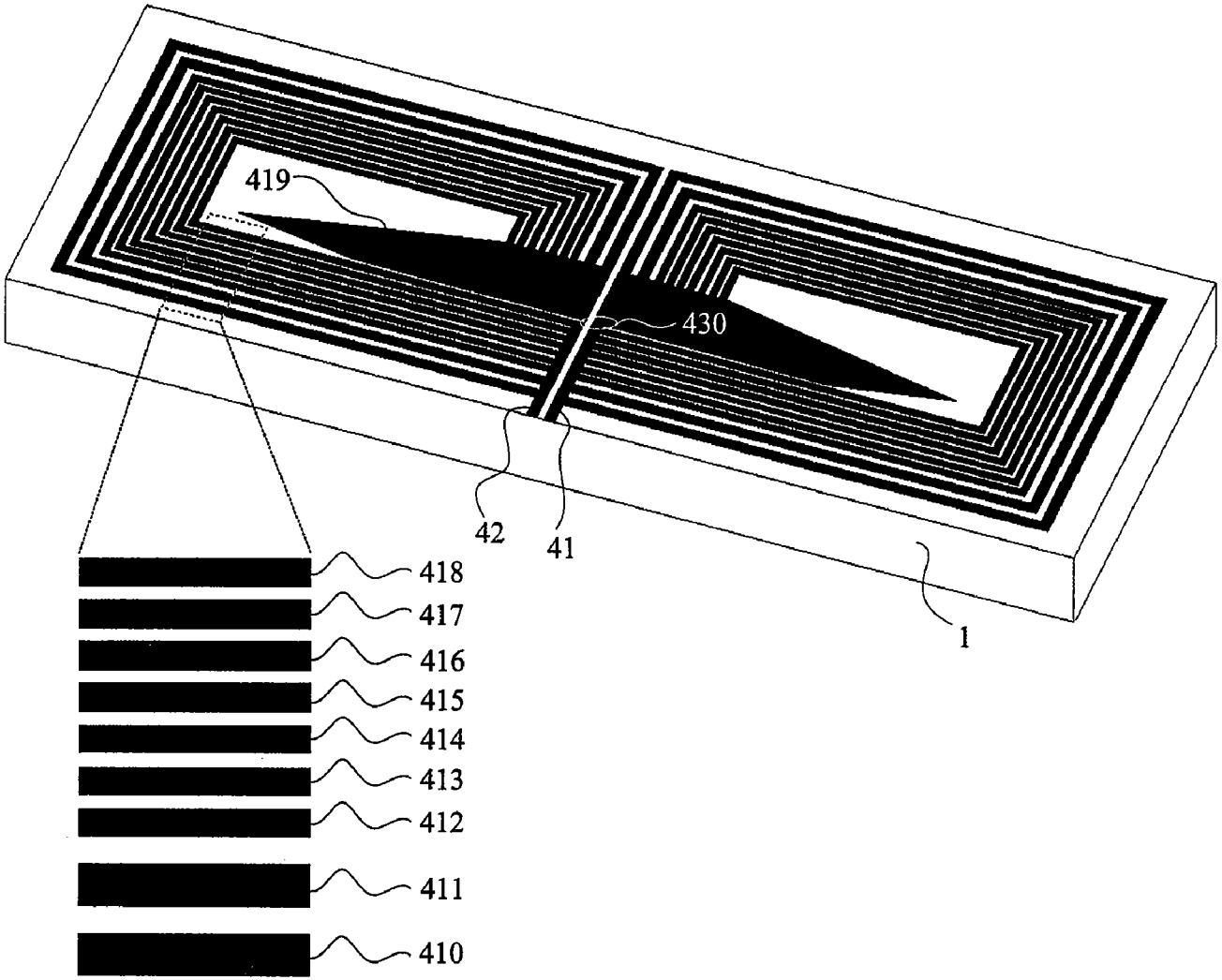
FIG. 5 is a diagram of the antenna architecture according to a third embodiment of the present invention.
Figure 6:
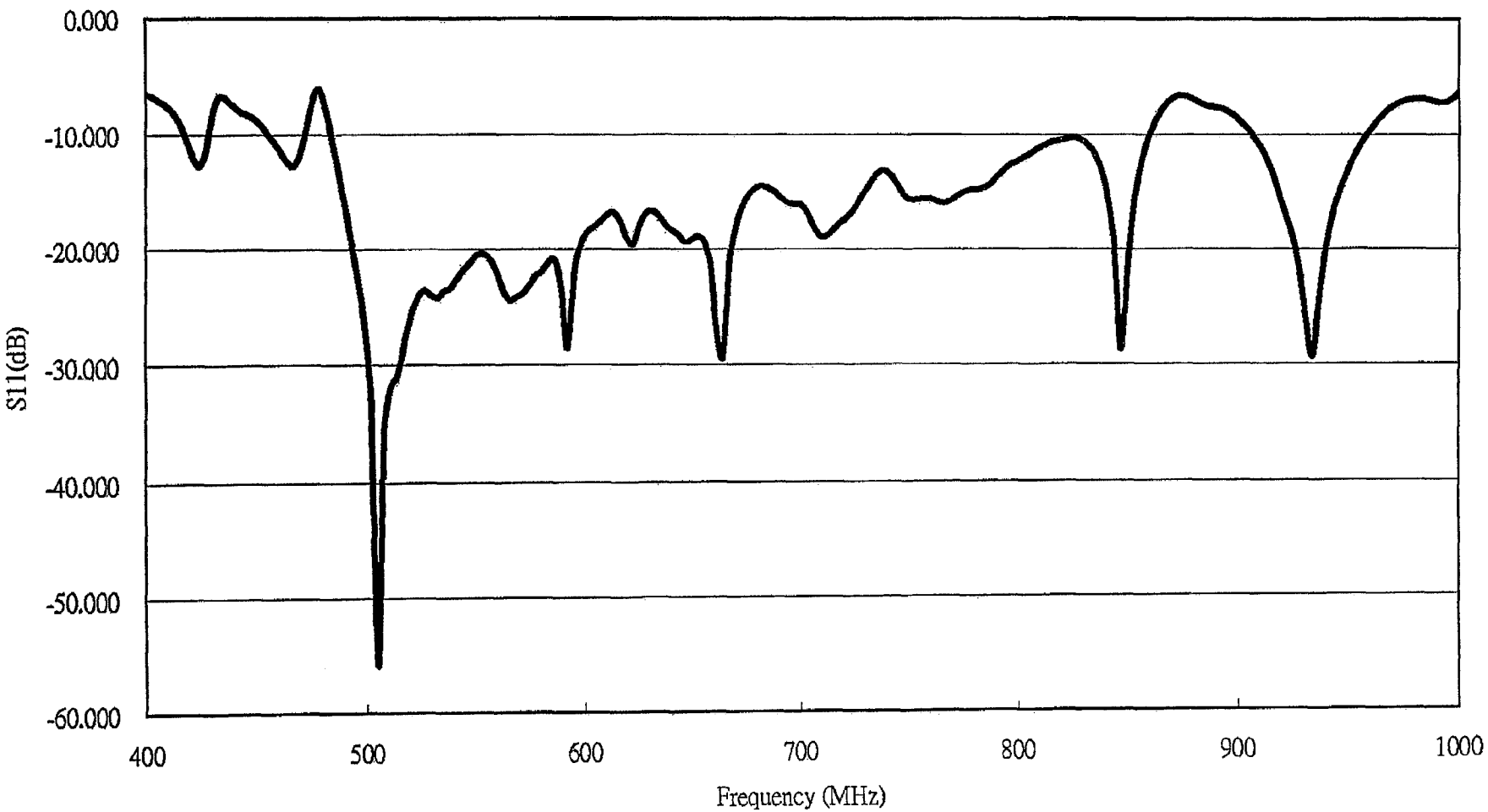
FIG. 6 is a diagram of the experimental data according to the third embodiment of the present invention.

The third embodiment of the present invention differs from the above embodiments in that an asymmetric mechanism is added in the signal source with respect to the ground to enhance the receiving performance of the whole antenna. As shown in FIG. 5, the wideband planar dipole antenna comprises a substrate 1, a first antenna body 41 and a second antenna body 42. Copper foil is printed on the upper surface of the substrate 1 to form the first and second antenna bodies 41 and 42. The first antenna body 41 is the signal source, while the second antenna body 42 is the ground. Each of the first and second antenna bodies 41 and 42 is composed of nine-loop copper foils 410, 411, 412, 413, 414, 415, 416, 417 and 418 and a polygonal copper foil 419. In addition to having the same pattern as the second embodiment, the third embodiment also has an asymmetric mechanism (called an extra loop copper foil 430) added in the first antenna body 41 (signal source) with respect to the second antenna body (ground). Besides letting the antenna have the resonance effect of the symmetric part, the extra loop copper foil 430 also has the function of extra increasing the loop path of the signal source to enhance the receiving effect of the antenna, minimizing the total return loss of the antenna. Measured data of the return loss (S11) in FIG. 6 shows that the frequency range with the S11 below −10 dB is the preferred usage range of the present invention. As compared to the measured data of the second embodiment (FIG. 4), the third embodiment has the effect of minimizing the return loss in the resonance frequency band.

Figure 7:
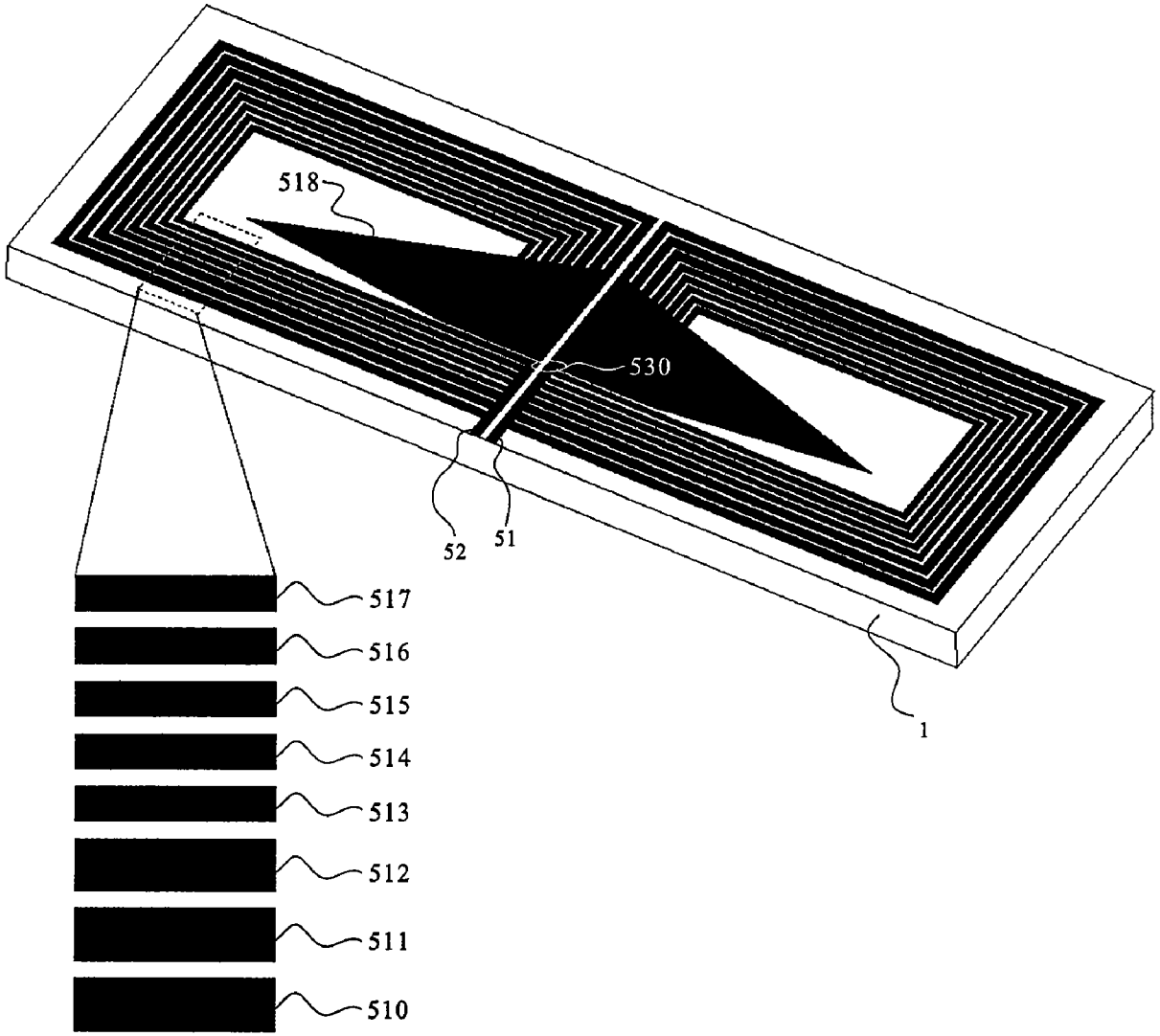
FIG. 7 is a diagram of the antenna architecture according to a fourth embodiment of the present invention.

FIG. 7 shows a wideband planar dipole antenna according to the fourth embodiment of the present invention. As shown in FIG. 7, the fourth embodiment integrates the multiple loop copper foil structure adopted in the above three embodiment and the asymmetric mechanism to manufacture a digital TV receiving antenna applicable in the UHF band. The wideband planar dipole antenna comprises a substrate 1, a first antenna body 51 and a second antenna body 52. Copper foil is printed on the upper surface of the substrate 1 to form the first and second antenna bodies 51 and 52. The first antenna body 51 is used as the signal source, while the antenna body 52 is used as the ground. Each of the first and second antenna bodies 51 and 52 is composed of eight loop copper foils 510, 511, 512, 513, 514, 515, 516 and 517 and a polygonal copper foil 518. The loop copper foil 510 is the outmost perimeter of the first and second antenna bodies 51 and 52, surrounds a rectangle with an appropriate size, and is finally connected to the polygonal copper foil 518. Its surrounding length is the longest of all the loop copper foils. The loop copper foil 510 is used to resonate at the lowest frequency in the designed frequency band. At an appropriate spacing, the loop copper foil 511 surrounds a rectangle inside the loop copper foil 510, and is finally connected to the polygonal copper foil 518. Its surrounding length is slightly shorter than that of the loop copper foil 510. Reasoning by analogy, at respectively appropriate spacing, the loop copper foil 512 surrounds a rectangle inside the loop copper foil 511, the loop copper foil 513 surrounds a rectangle inside the loop copper foil 512, the loop copper foil 514 surrounds a rectangle inside the loop copper foil 513, the loop copper foil 515 surrounds a rectangle inside the loop copper foil 514, the loop copper foil 516 surrounds a rectangle inside the loop copper foil 515, the loop copper foil 517 surrounds a rectangle inside the loop copper foil 516, and they all are finally connected to the polygonal copper foil 518. The surrounding lengths of the loop copper foils 510, 511, 512, 513, 514, 515, 516 and 517 diminish gradually, with the loop copper foil 510 having the longest length and the loop copper foil 517 having the shortest length.

Figure 8:
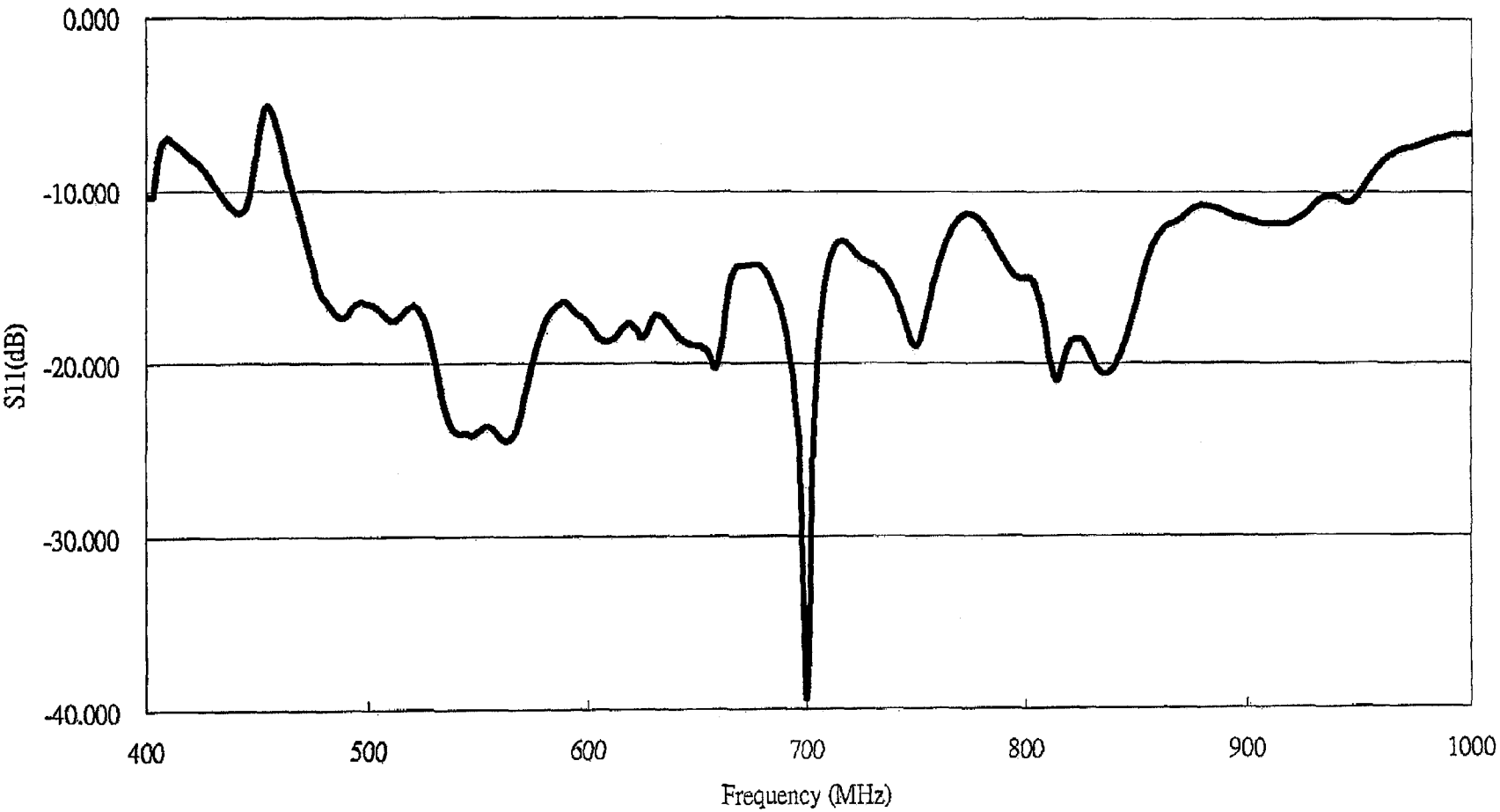
FIG. 8 is a diagram of the experimental data according to the fourth embodiment of the present invention.

In addition to having the pattern symmetric to the second antenna body 52, the first antenna body 51 (signal source) also has the extra loop copper foil 530 in the third embodiment. The antenna of the fourth embodiment of the present invention has a return loss below −10 dB between 465 MHz and 880 MHz, and is a very wide band antenna with a center frequency of 672.5 MHz and a 61.7% bandwidth ratio. Measured data of the return loss (S11) in FIG. 8 shows that the frequency range with the S11 below −10 dB is the preferred usage range of the present invention.

Figure 9:
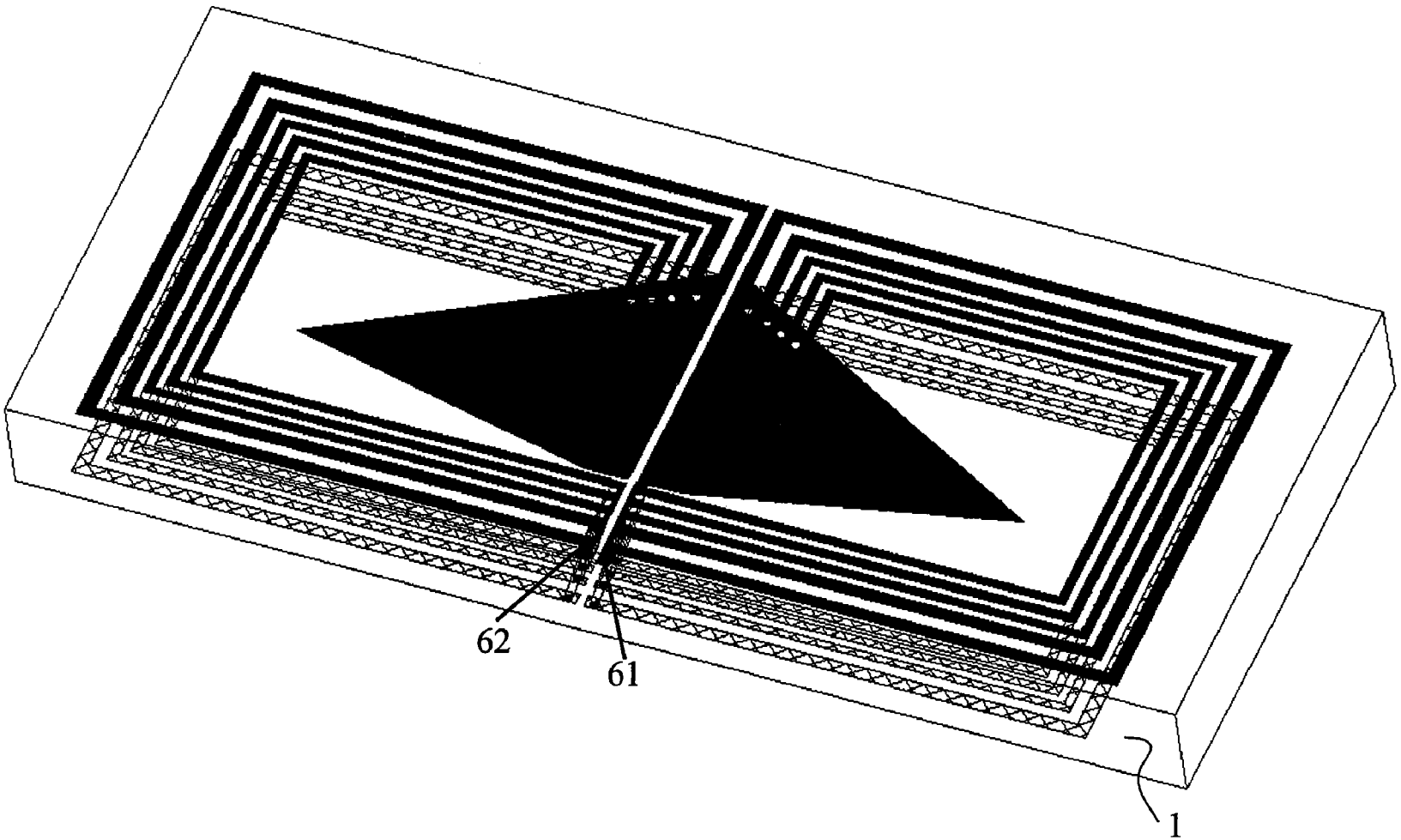
FIG. 9 is a diagram of the antenna architecture according to a fifth embodiment of the present invention.
Figure 10:
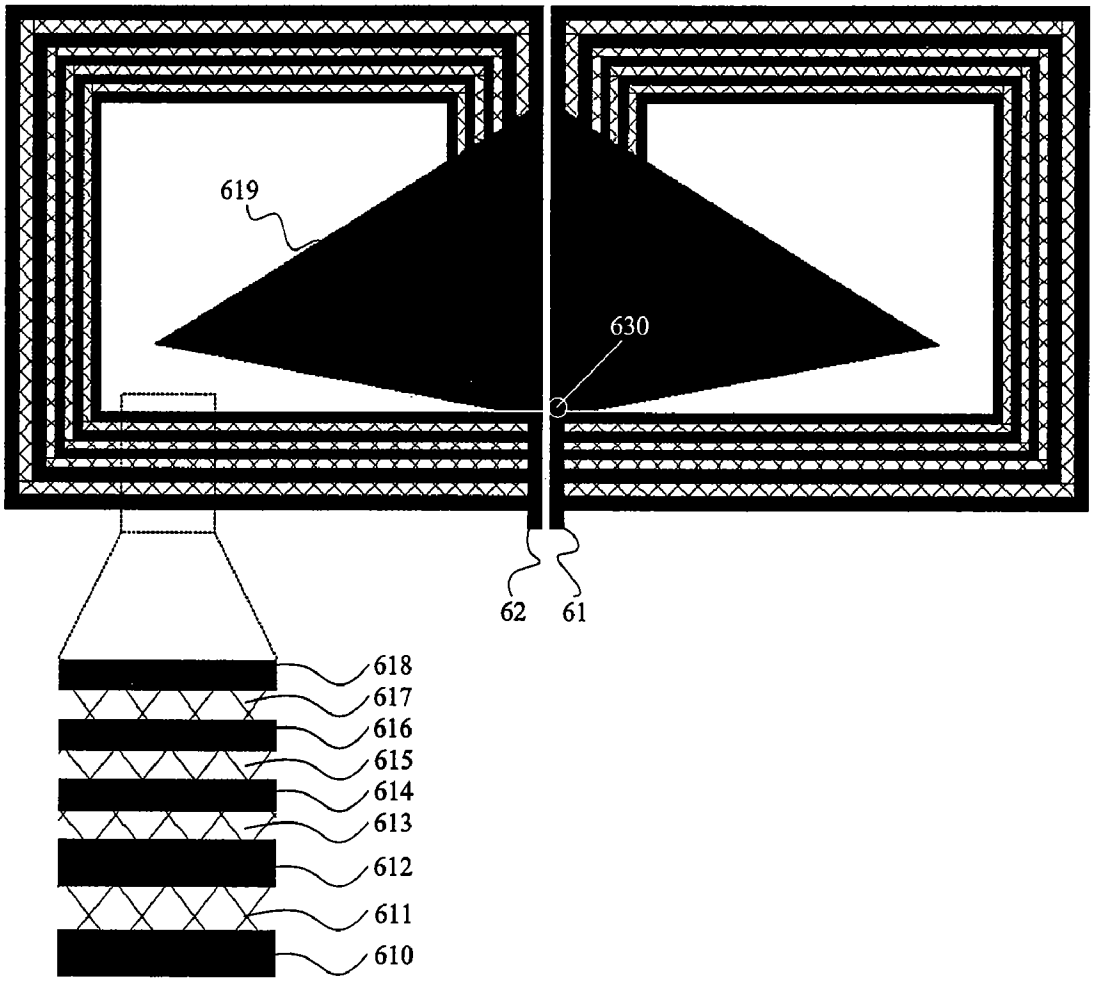
FIG. 10 is a top view of the antenna architecture according to the fifth embodiment of the present invention.
Figure 11:
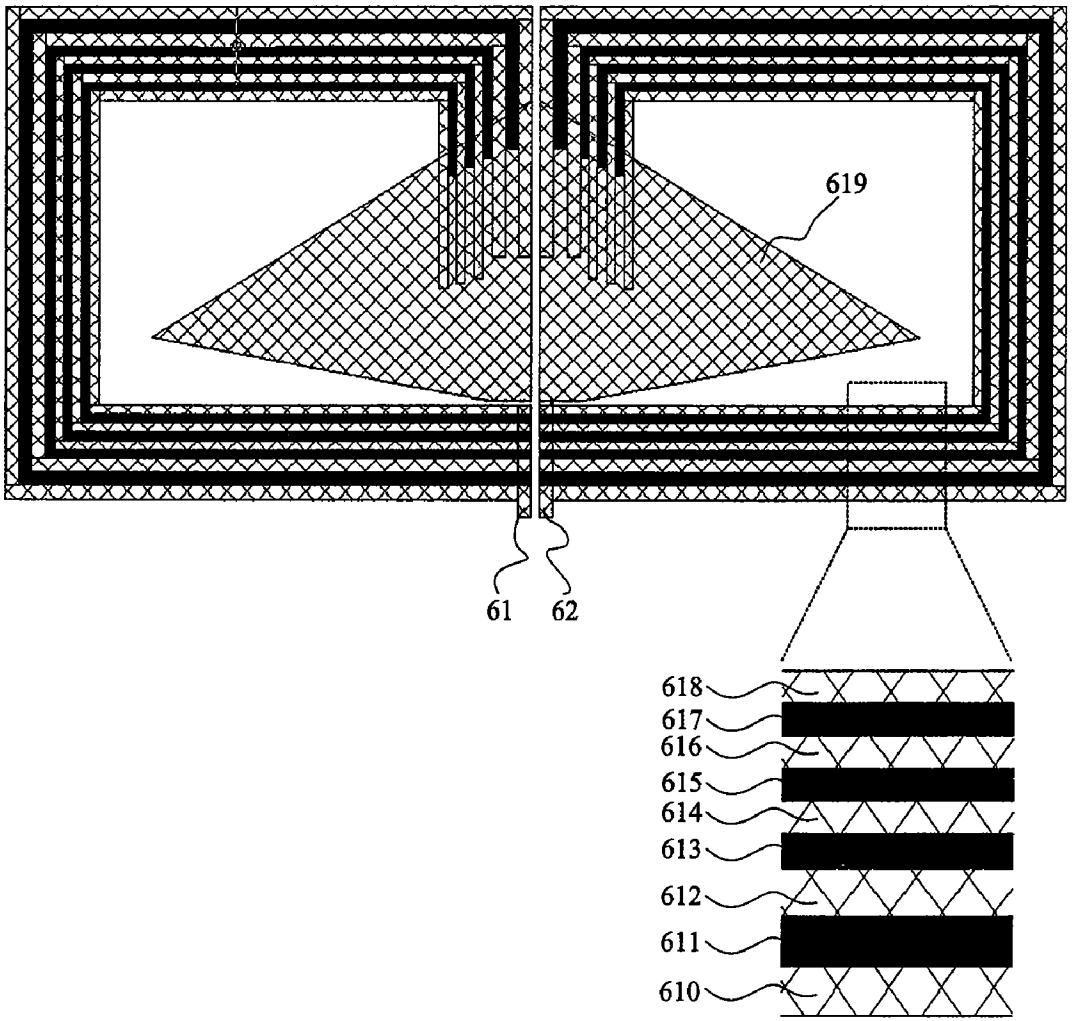
FIG. 11 is a bottom view of the antenna architecture according to the fifth embodiment of the present invention.
Figure 12:
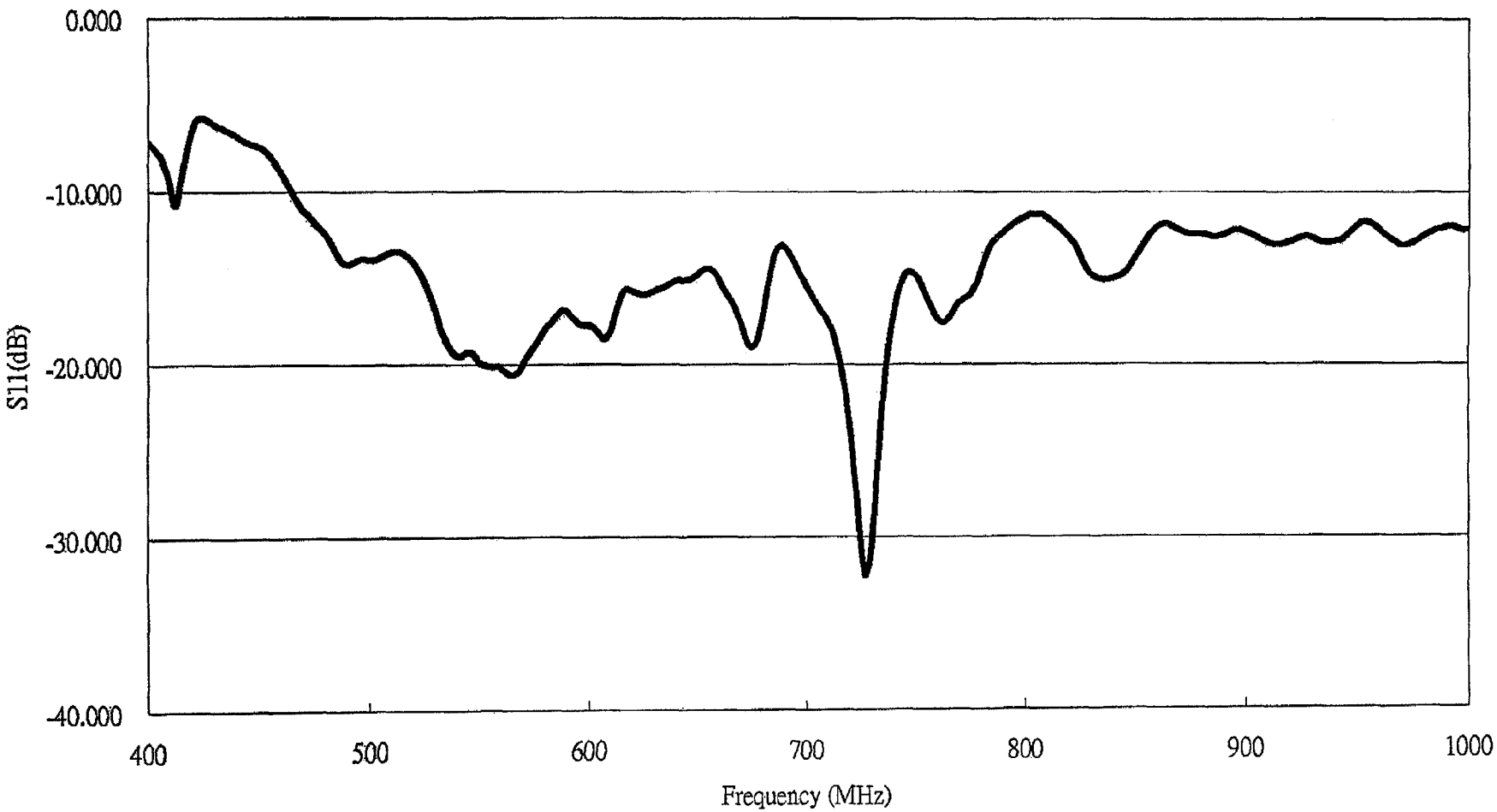
FIG. 12 is a diagram of the experimental data according to the fifth embodiment of the present invention.

FIG. 9 is a diagram of the antenna architecture according to a fifth embodiment of the present invention. FIG. 10 is a top view of the antenna architecture according to the fifth embodiment of the present invention. FIG. 11 is a bottom view of the antenna architecture according to the fifth embodiment of the present invention. As shown in FIGS. 9, 10 and 11, the fifth embodiment is characterized in that multiple loop copper foils are used to manufacture a digital TV receiving antenna applicable in the UHF band by utilizing a double-surface routing mechanism. The wideband planar dipole antenna comprises a substrate 1, a first antenna body 61 and a second antenna body 62. Copper foil is printed on the surfaces of the substrate 1 to form the first and second antenna bodies 61 and 62. The first antenna body 61 is used as the signal source, while the antenna body 62 is used as the ground. Each of the first and second antenna bodies 61 and 62 is composed of nine loop copper foils 610, 611, 612, 613, 614, 615, 616, 617 and 618 and a polygonal copper foil 619. The loop copper foil 610 is the outmost perimeter of the first antenna body 61, surrounds a rectangle with an appropriate size on the front surface of the antenna, and is finally connected to the polygonal copper foil 619. Its surrounding length is the longest of all the loop copper foils. The loop copper foil 610 is used to resonate at the lowest frequency in the designed frequency band. At an appropriate spacing, the loop copper foil 611 surrounds a rectangle inside the loop copper foil 610 on the back surface of the antenna, and is finally connected to the polygonal copper foil 619. The loop copper foil 611 uses two feed lines to penetrate and connect the front and back surfaces of the substrate 1. Its surrounding length is slightly shorter than that of the loop copper foil 610. Reasoning by analogy, at respectively appropriate spacing, the loop copper foil 612 surrounds a rectangle inside the loop copper foil 611 on the front surface of the substrate 1, the loop copper foil 613 surrounds a rectangle inside the loop copper foil 612 on the back surface of the substrate 1, the loop copper foil 614 surrounds a rectangle inside the loop copper foil 613 on the front surface of the substrate 1, the loop copper foil 615 surrounds a rectangle inside the loop copper foil 614 on the back surface of the substrate 1, the loop copper foil 616 surrounds a rectangle inside the loop copper foil 615 on the front surface of the substrate 1, the loop copper foil 617 surrounds a rectangle inside the loop copper foil 616 on the back surface of the substrate 1, the loop copper foil 618 surrounds a rectangle inside the loop copper foil 617 on the front surface of the substrate 1, and they all are finally connected to the polygonal copper foil 619. The routing is alternately distributed on the front and back surfaces of the substrate 1 at appropriate spacing. The surrounding lengths of the loop copper foils 610, 611, 612, 613, 614, 615, 616, 617 and 618 diminish gradually, with the loop copper foil 610 having the longest length and the loop copper foil 618 having the shortest length. The loop copper foils on the back surface can be connected with the loop copper foils on the front surface using feed lines. In addition to having the pattern symmetric to the second antenna body 62, the first antenna body 61 (signal source) also has the extra loop copper foil 630 in the third embodiment. The antenna of the fifth embodiment of the present invention has a return loss below −10 dB between 468 MHz and 958 MHz, and is a very wide band antenna with a center frequency of 713 MHz and a 68.9% bandwidth ratio. Measured data of the return loss (S11) in FIG. 12 shows that the frequency range with the S11 below −10 dB is the preferred usage range of the present invention.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

We claim:

1. A wideband planar dipole antenna comprising:

a substrate;

a first antenna body being located on one side of said substrate, said first antenna body being made of a first metal conductor with loops in a multi-loop routing configuration to be used as a radiation area;

a second metal conductor wherein one end of each loop of the first metal conductor connects to an end of the second metal conductor, the other end of each loop of the first metal conductor connects to a signal source, and another end of the second metal conductor is opened;

a second antenna body being located on one side of said substrate, said second antenna body being made of a third metal conductor with loops in a multi-loop routing configuration to be used as a radiation area; and a fourth metal conductor wherein one end of each loop of the third metal conductor connects to an end of the fourth metal conductor, the other end of each loop of the third metal conductor connects to a ground, and another end of the fourth metal conductor is opened.

2. The wideband planar dipole antenna as claimed in claim 1 further comprising a third antenna body and a fourth antenna body on said substrate, wherein said third and fourth antenna bodies correspond to said first and second antenna bodies to form a double-surface wideband planar dipole antenna.

3. The wideband planar dipole antenna as claimed in claim 1, wherein said first antenna body and said second antenna body are printed on said substrate.

4. The wideband planar dipole antenna as claimed in claim 1, wherein shape of the loops of the first antenna body and shape of the loops of the second antenna body are identical and are selected from a circular polygonal shape, an elliptical shape, a polygonal shape, a star shape, or an irregular shape.

5. The wideband planar dipole antenna as claimed in claim 1, wherein shapes of said second metal conductor and said fourth metal conductor are selected from a circular polygonal shape, an elliptical shape, a polygonal shape, a star shape, or an irregular shape.

6. The wideband planar dipole antenna as claimed in claim 1, wherein said substrate is made of glass, ceramic or silicon.

7. A wideband planar dipole antenna comprising:

a substrate;

a first antenna body used as a signal source, said first antenna body being located on one side of said substrate, said first antenna body being made of a first metal conductor with loops in a multi-loop routing configuration to be used as a radiation area;

a first end of a second metal conductor connects the loops of said first antenna body, a second end of said second metal conductor having conductive element connected to said signal source, and a third end of said second metal conductor is opened;

a second antenna body being located on one side of said substrate, said second antenna body being made of a third metal conductor with loops in a multi-loop routing configuration to be used as a radiation area; and a fourth metal conductor wherein one end of each loop of the third metal conductor connects to an end of the fourth metal conductor, and the other end of each loop of the third metal conductor connects to a ground.

8. The wideband planar dipole antenna as claimed in claim 7 further comprising a third antenna body and a fourth antenna body on said substrate, wherein said third and fourth antenna bodies correspond to said first and second antenna bodies to form a double-surface wideband planar dipole antenna.

9. The wideband planar dipole antenna as claimed in claim 7, wherein said first antenna body and said second antenna body are printed on said substrate.

10. The wideband planar dipole antenna as claimed in claim 7, wherein shapes of the loops of the first and second antenna bodies are identical and are selected from a circular polygonal shape, an elliptical shape, a polygonal shape, a star shape, or an irregular shape.

11. The wideband planar dipole antenna as claimed in claim 7, wherein shapes of said second metal conductor and said fourth metal conductor are selected from a circular polygonal shape, an elliptical shape, a polygonal shape, a star shape, or an irregular shape.

12. The wideband planar dipole antenna as claimed in claim 7, wherein said substrate is made of glass, ceramic or silicon.

* * * * *